US007428938B2

(12) United States Patent
Marshall

(10) Patent No.: US 7,428,938 B2
(45) Date of Patent: Sep. 30, 2008

(54) PERCUSSION BIT DRILL DRIVE COLLAR WITH RETENTION MECHANISM AND METHOD OF ASSEMBLING

(75) Inventor: Alan J. Marshall, Lost Creek, WV (US)

(73) Assignee: Smith International, Inc., Houston, TX (US)

( * ) Notice: Subject to any disclaimer, the term of this patent is extended or adjusted under 35 U.S.C. 154(b) by 84 days.

(21) Appl. No.: 11/375,953

(22) Filed: Mar. 15, 2006

(65) Prior Publication Data

US 2007/0261885 A1 Nov. 15, 2007

(51) Int. Cl.
*E21B 10/36* (2006.01)

(52) U.S. Cl. ..... 175/414; 175/415; 175/293

(58) Field of Classification Search ..... 166/293, 166/296, 321, 414, 415; 175/293, 296, 321, 175/414, 415
See application file for complete search history.

(56) References Cited

U.S. PATENT DOCUMENTS

| | | | | | |
|---|---|---|---|---|---|
| 3,322,216 | A | | 5/1967 | Kurt | 175/293 |
| 3,353,613 | A | | 11/1967 | Harrison | 175/293 |
| 4,241,800 | A | | 12/1980 | Stenuick | 175/400 |
| 4,727,944 | A | | 3/1988 | Bottoms | 175/293 |
| 4,932,483 | A | * | 6/1990 | Rear | 175/296 |
| 5,065,827 | A | * | 11/1991 | Meyers et al. | 175/414 |
| 5,139,096 | A | * | 8/1992 | Lister | 175/92 |
| 5,390,749 | A | | 2/1995 | Lyon | 175/296 |
| 5,407,021 | A | * | 4/1995 | Kane et al. | 175/296 |
| 5,435,402 | A | | 7/1995 | Ziegenfuss | 175/414 |
| 5,699,867 | A | * | 12/1997 | Jones | 175/296 |
| 5,735,358 | A | * | 4/1998 | Lyon | 175/96 |
| 6,021,856 | A | | 2/2000 | Pascale | 175/414 |
| 6,035,953 | A | * | 3/2000 | Rear | 175/171 |
| 6,070,678 | A | * | 6/2000 | Pascale | 175/300 |
| 6,516,903 | B2 | | 2/2003 | Rogers | 175/300 |
| 6,702,045 | B1 | * | 3/2004 | Elsby | 175/93 |
| 6,761,231 | B1 | | 7/2004 | Dock et al. | 175/51 |
| 6,789,632 | B2 | | 9/2004 | Green | 175/300 |
| 6,827,162 | B2 | | 12/2004 | Fisher | 175/414 |
| 6,938,710 | B2 | | 9/2005 | Simmons | 175/57 |
| 2003/0102167 | A1 | * | 6/2003 | Pascale et al. | 175/415 |
| 2004/0188146 | A1 | * | 9/2004 | Egerstrom | 175/296 |
| 2006/0096787 | A1 | * | 5/2006 | Underwood et al. | 175/294 |
| 2007/0137895 | A1 | * | 6/2007 | Marshall et al. | 175/57 |

* cited by examiner

*Primary Examiner*—David Bagnell
*Assistant Examiner*—David Andrews
(74) *Attorney, Agent, or Firm*—Conley Rose, P.C.

(57) ABSTRACT

A drive collar is disclosed for use in a percussion drilling apparatus of the type for boring into the earth. Embodiments of the drive collar include a generally tubular, one-piece body further having an inner surface, an outer surface, a first end and a second end. Embodiments further include a threaded section on the outer surface, a retention mechanism on the inner surface, a plurality of splines on the inner surface; and a shoulder on the outer surface.

9 Claims, 9 Drawing Sheets

PERCUSSION BIT DRILL DRIVE COLLAR WITH RETENTION MECHANISM AND METHOD OF ASSEMBLING

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

1. Technical Field

This disclosure generally relates to earth boring bits used to drill a borehole for applications including the recovery of oil, gas or minerals, mining, blast holes, water wells and construction projects. More particularly, the disclosure relates to percussion hammer drill bits.

2. Description of the Related Art

In percussion hammer drilling operations, the bit impacts the earth in a cyclic fashion while simultaneously rotating. In such operations, the mechanism for penetrating the earth is of an impacting nature rather than shearing. Therefore, in order to promote efficient penetration by the bit, the cutting elements of the bit need to be "indexed" to fresh earthen formations between each impact. This need is achieved by rotating the drill string a slight amount between each impact of the bit to the earth and incorporating longitudinal splines which key the bit body to a cylindrical sleeve (commonly known as the driver sub or chuck) at the bottom of the hammer assembly. As a result of this arrangement, the drill string rotation is thereby transferred to the hammer bit itself. Experience has demonstrated for an eight inch diameter hammer bit that a rotational speed of approximately 20 rpm for an impact frequency of 1600 bpm (beats per minute) results in efficient drilling operations. This rotational speed translates to an angular displacement of approximately 4 to 5 degrees per impact of the bit against the rock formation.

An example of a typical hammer bit connected to a rotatable drill string is described in U.S. Pat. No. 4,932,483, incorporated herein by reference. The downhole hammer comprises a top sub and a drill bit separated by a tubular housing incorporating a piston chamber therebetween. A feed tube is mounted to the top sub and extends concentrically into the piston chamber. A piston is slideably received within the housing and over the feed tube. Fluid porting is provided in the feed tube and the piston. This porting admits fluid in a first space between the piston and top sub to drive the piston towards the drill bit support, and thereafter to a second space between the piston and the drill bit support to drive the piston towards the top sub.

Rotary motion is provided to this conventional hammer assembly and drill bit by the attached drill string which, in turn, is powered by a rotary table typically mounted on the rig platform or by a top drive head mounted on the derrick. The drill bit is rotated through engagement of a series of splines on the bit and driver sub that allow axial sliding between the two components.

Due to the forces transmitted between the splines, as well as the cyclic nature of the stress created, mechanical failure of the splines can force an operator to remove the drill bit from operation for repair or replacement, thereby increasing maintenance and operation costs. If a portion of the drill bit completely fractures, it can become separated from the rest of the percussion drill assembly. In such a case, mere removal of the drill assembly from the borehole by withdrawing (or "tripping") the drillstring will not extract the fractured portion of the drill bit. Instead, the fragment must be removed by a separate and time-consuming procedure, adding still further cost. It is therefore desirable to retain any fractured portions of the drill bit with the rest of the percussion drill assembly, thereby allowing the fractured portion to be extracted simultaneously with the withdrawal of the drillstring from the borehole.

The embodiments of the present invention described herein provide opportunities for improvement in retaining the drill bit in the event of a fracture. These and various other characteristics and advantages will be readily apparent to those skilled in the art upon reading the following detailed description of the preferred embodiments of the invention, and by referring to the accompanying drawings.

SUMMARY OF THE PREFERRED EMBODIMENTS

Embodiments of the present invention comprise a drive collar with a retention mechanism for use in a percussion drilling apparatus of the type for boring into the earth. In certain embodiments, the drive collar comprises a one-piece or unitary generally tubular body with a threaded section on the outer surface and proximal to a first end of the body and a retention mechanism on the inner surface proximal to the second end of the body. Embodiments further comprise a plurality of splines on the inner surface and a shoulder on the outer surface disposed at a location between the threaded section and the retention mechanism. The retention mechanism may comprise different configurations, such as a threaded section or a retaining ring.

BRIEF DESCRIPTION OF THE DRAWINGS

For a more detailed description of the preferred embodiments, reference will now be made to the accompanying drawings, wherein.

DETAILED DESCRIPTION OF THE PREFERRED EMBODIMENT

Figure 1:
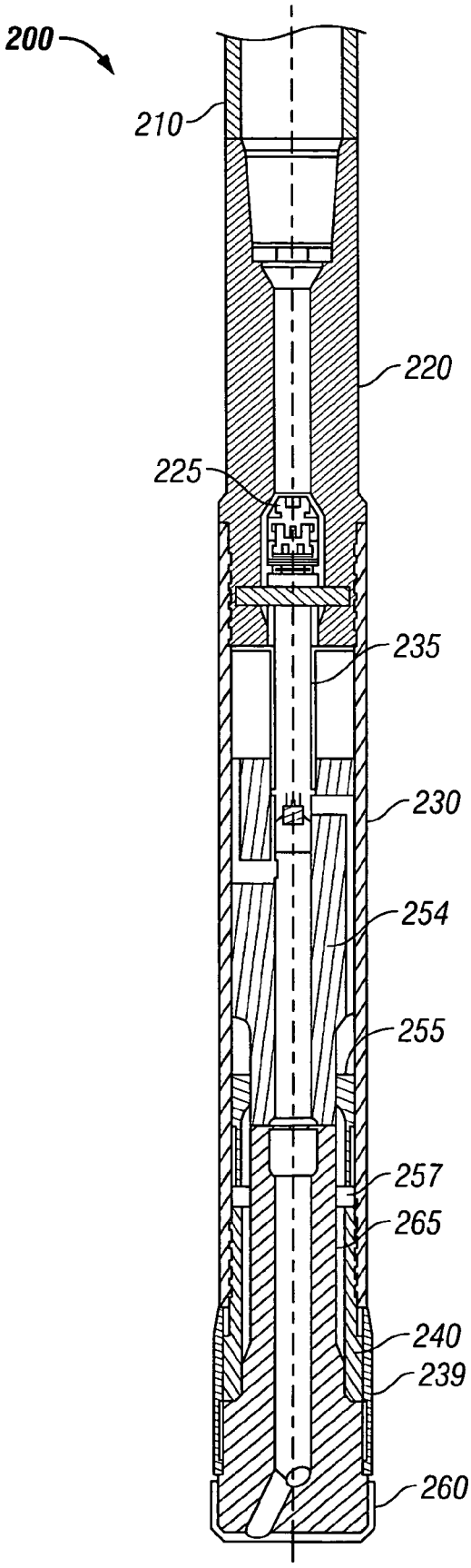
FIG. 1 (Prior Art)
FIG. 1 is a cross-section of a prior art percussion hammer drilling assembly.
Figure 1A:
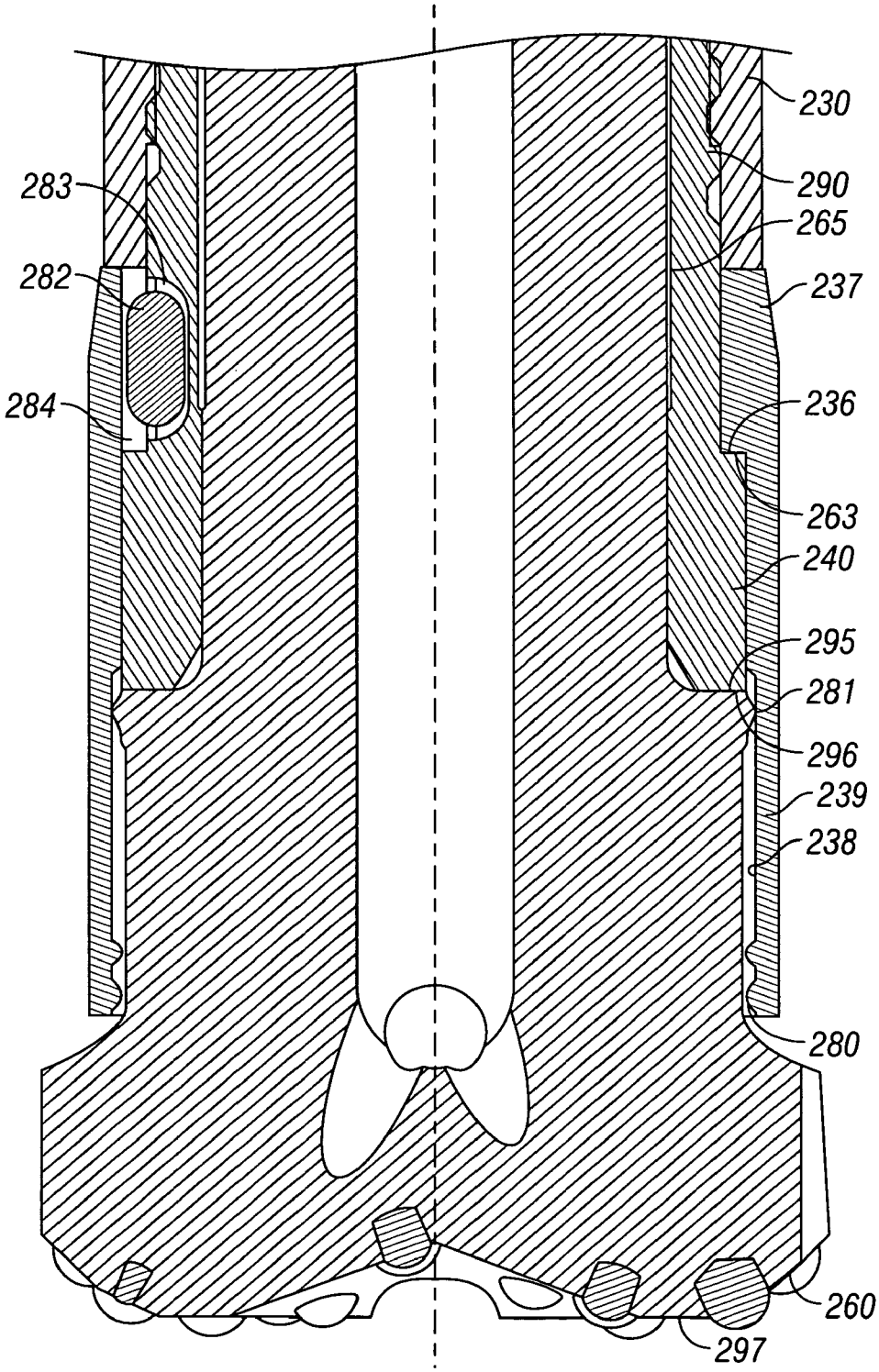
FIG. 1A (Prior Art)
FIG. 1A is an enlarged partial cross-section view of the prior art percussion hammer drilling assembly of FIG. 1.

Referring first to FIGS. 1 and 1A, a cross-section of a typical prior art percussion drilling assembly 200 is shown attached to a drillstring 210. Assembly 200 comprises a top sub 220 threadably connected to a case 230, which is threadably connected to a driver sub 240. Driver sub 240 is slideably engaged with a bit 260. Captured between case 230 and driver sub 240 is a retainer 239, which extends to a position below driver sub 240. Top sub 220 further comprises a check valve 225 and a feed tube 235 that extends from check valve 225 to a piston 254 that is slideably engaged with a guide sleeve 255.

During operation, drillsting 210 rotates, thereby rotating percussion drilling assembly 200. In addition, piston 254 travels back and forth in an axial direction so that it cyclically impacts bit 260. A series of splines 265 on bit 260 engage driver sub 240 and allow bit 260 to slide axially relative to driver sub 240 while also allowing driver sub 240 to rotate bit 260. As described previously, this allows the cutting elements (not shown) of bit 260 to be "indexed" to fresh rock formations during each impact of bit 260, thereby improving the efficiency of the drilling operation.

As previously described, bit 260 is slideably engaged with driver sub 240 and is therefore free to move axially with respect to driver sub 240. A bit retaining ring 257 retains bit 260 within drilling assembly 200 and prevents bit 260 from sliding out of the end of drilling assembly 200. As explained more fully below, if bit 260 fractures below bit retaining ring 257, retainer 239 prevents a fractured portion of bit 260 from falling out of the end of drilling assembly 200. This prevents the fractured portion from separating from the rest of drilling assembly 200 and allows the fractured portion to be extracted from the borehole by withdrawing drilling assembly 200.

A more detailed view of driver sub 240 and retainer 239 is shown in FIG. 1A. In this view, retainer 239 is shown to comprise an upper portion 237 and a lower portion 238. Upper portion 237 has a retainer shoulder 236 that engages a driver shoulder 263, while lower portion 238 has retainer threads 280, which must be threaded past bit threads 281 during assembly. A key 282 is also disposed between a driver keyway 283 and a retainer keyway 284. Driver sub 240 comprises a plurality of splines (not visible in FIG. 1A) that engage bit splines 265 and driver sub threads 290 which threadably engage casing 230.

The assembly shown in FIG. 1A is typically assembled by sliding driver sub 240 onto bit 260 so that bit splines 265 engage driver sub splines (not visible in FIG. 1A) and an end 295 of driver sub 240 contacts a bit shoulder 296. A key 282 is placed in a driver keyway 283 and retainer 239 is placed onto bit 260 so that retainer threads 280 engage bit threads 281. Retainer 239 is rotated relative to bit 260 so that retainer threads 280 are disengaged from bit threads 281 and retainer 239 can be moved axially towards an end 297 of bit 260. Retainer 239 is aligned with driver sub 240 so that key 282 aligns with retainer keyway 284 and retainer 239 is then moved towards end 297 until retainer shoulder 236 engages driver sub shoulder 263.

Driver sub threads 290 are threadably engaged with case 230 so that upper portion 237 of retainer 239 is captured between the end of case 230 and driver sub shoulder 263. In typical applications, driver sub 240 is threadably engaged with case 230 so that upper portion 237 is placed under a compressive stress. The cyclical forces generated in a percussion drilling assembly can therefore lead to stress or fatigue fractures near retainer shoulder 236 and driver sub shoulder 263. Geometrical constraints also make it difficult to enlarge the cross-sectional thickness of upper portion 237 or retainer shoulder 236 to reduce the likelihood of such failures. For example, upper portion 237 must slide axially past driver sub threads 290 during assembly, so the thickness of upper portion 237 cannot be increased inwardly. In addition, the geometry of bit 260 dictates the size of the bore being drilled, and thereby provides a limitation on the maximum outer diameter that can be utilized for retainer 239.

Figure 2:
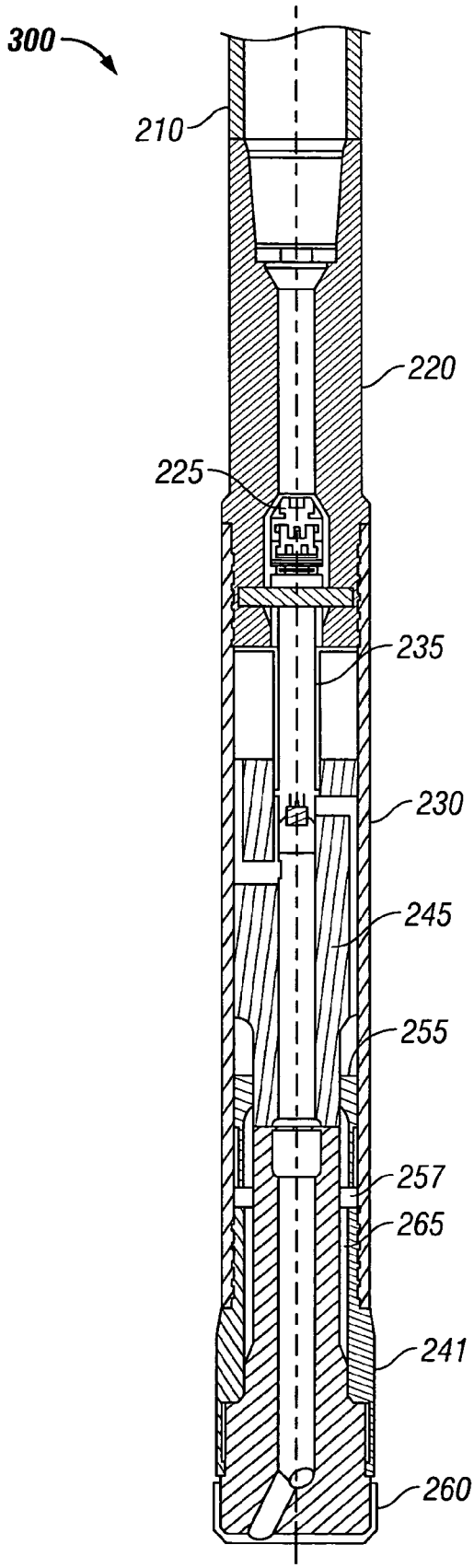
FIG. 2 is cross-section of a percussion hammer drilling assembly made in accordance with principles of the present invention.

Referring now to FIG. 2, drilling assembly 300 comprises a drive collar 241 that incorporates features of both a driver sub and a retainer. The other features and components of drilling assembly 300 are equivalent to those of drilling assembly 200 described in the discussion of FIGS. 1 and 1A. A more detailed view of drive collar 241 is depicted in FIGS. 3-5, which depict a cross-section view of drive collar 241 on bit 260.

Figure 3:
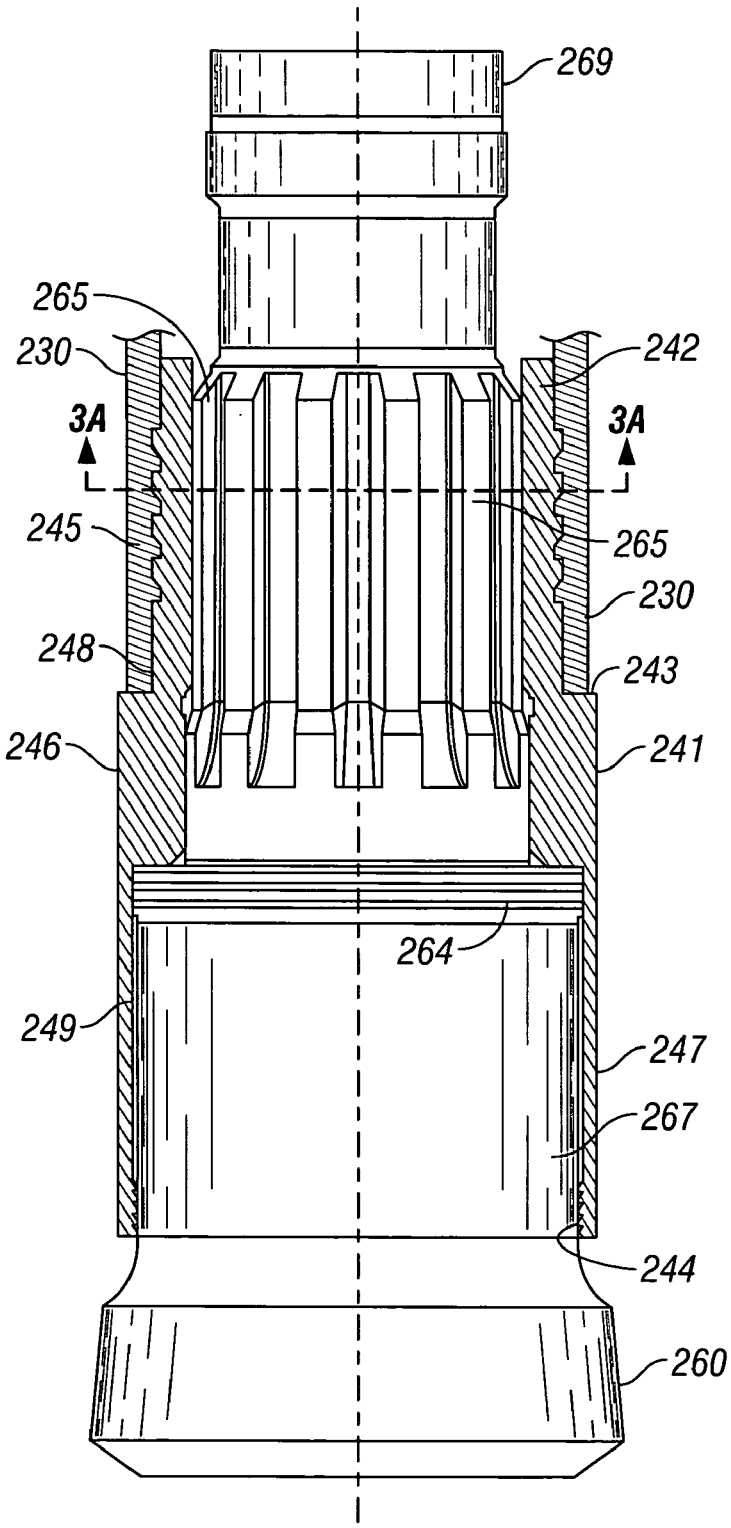
FIG. 3 is an enlarged partial cross-section view of the embodiment of FIG. 2.
Figure 3A:
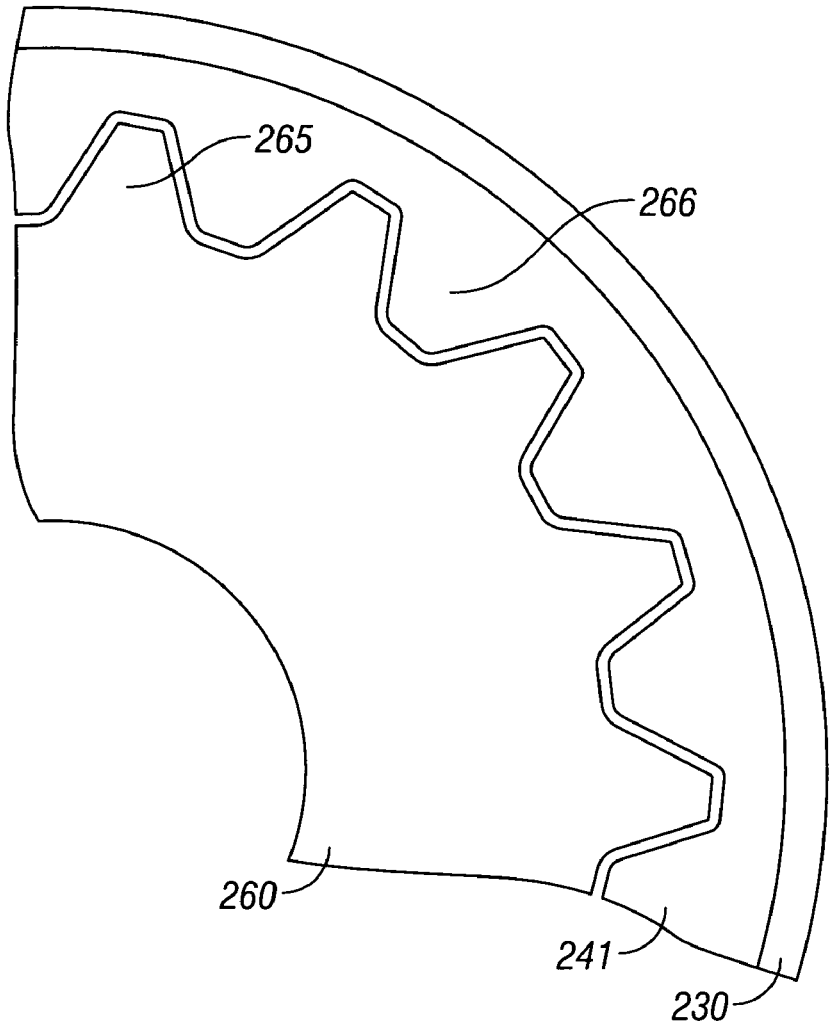
FIG. 3A is an enlarged partial cross-section of the embodiment of FIG. 3.

In the embodiment of FIG. 3, bit 260 comprises a top portion 269 and a plurality of splines 265 that engage splines 266 (visible in the section view of FIG. 3A) in drive collar 241. In addition, bit 260 comprises a threaded section 264 and a reduced diameter portion 267. In this embodiment, drive collar 241 is a generally cylindrical or tubular body extending from an upper portion 245 at one end to a lower portion (or extension) 247 at the opposing end. Drive collar 241 includes an outer surface 248 and an inner surface 249. Drive collar 241 further includes a central portion 246 between upper and lower portions 245 and 247. Outer surface 248 of drive collar 241 comprises an upper threaded section 242 that threadably engages case 230. Therefore, as case 230 rotates, both drive collar 241 and bit 260 will also rotate. Drive collar 241 also comprises a shoulder 243 on outer surface 248 and a threaded section 244 on inner surface 249 of extension 247. In the embodiment shown in FIGS. 3-5, upper portion 245, central portion 246, and lower portion 247 are manufactured by casting, molding, forging or similar manufacturing processes to form a single piece of material so that drive collar 241 is a unitary piece or one-piece body. In other embodiments, different components (such as upper portion 245 and lower portion 247) can be connected by welding or similar processes to form a unitary piece. As used herein, the terms "unitary piece" or "one-piece body" are defined as a component consisting of a single member or multiple members that are non-releasably connected.

Figure 4:
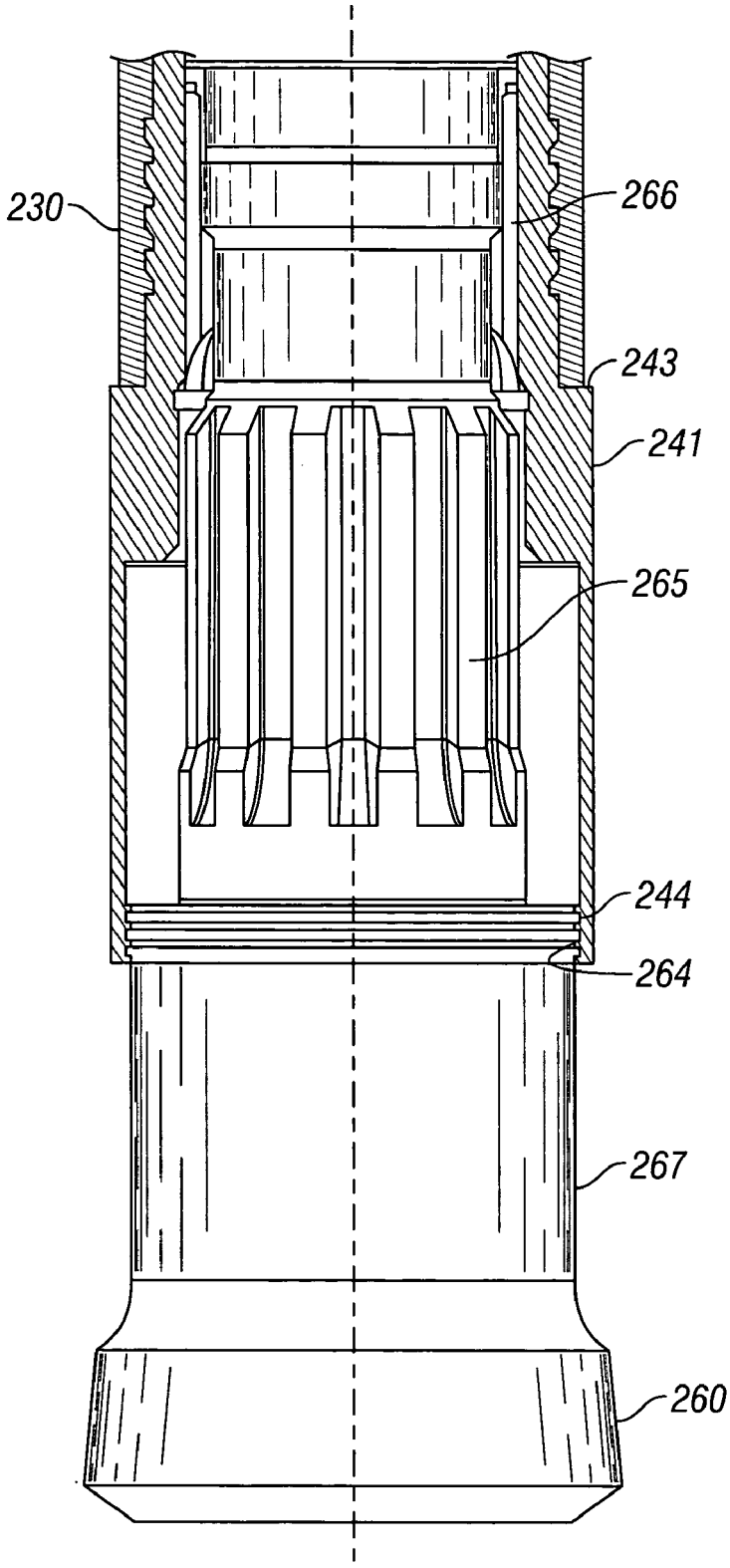
FIG. 4 is an enlarged partial cross-section view of the embodiment of FIG. 2 with the components shown as they appear during one stage of the assembly.

As shown in FIG. 4, drive collar 241 and bit 260 are initially assembled by engaging threaded section 244 of drive collar 241 with threaded section 264 of bit 260. At this point, splines 265 are not engaged with drive collar splines 266, so that drive collar 241 can be rotated relative to bit 260. Threaded section 244 is then threaded past threaded section 264, allowing splines 265 to be aligned with drive collar splines 266. After the splines are aligned and engaged, bit 260 can be further inserted into drive collar 241 so that reduced diameter portion 267 is received within extension 247. After assembly, threaded section 244 is proximal to (but not threadably engaged with) reduced diameter portion 267, allowing bit 260 to move axially with respect to drive collar 241. Case 230 is also threadably engaged with drive collar 241, so that the end of case 230 engages upper shoulder 243.

Figure 5:
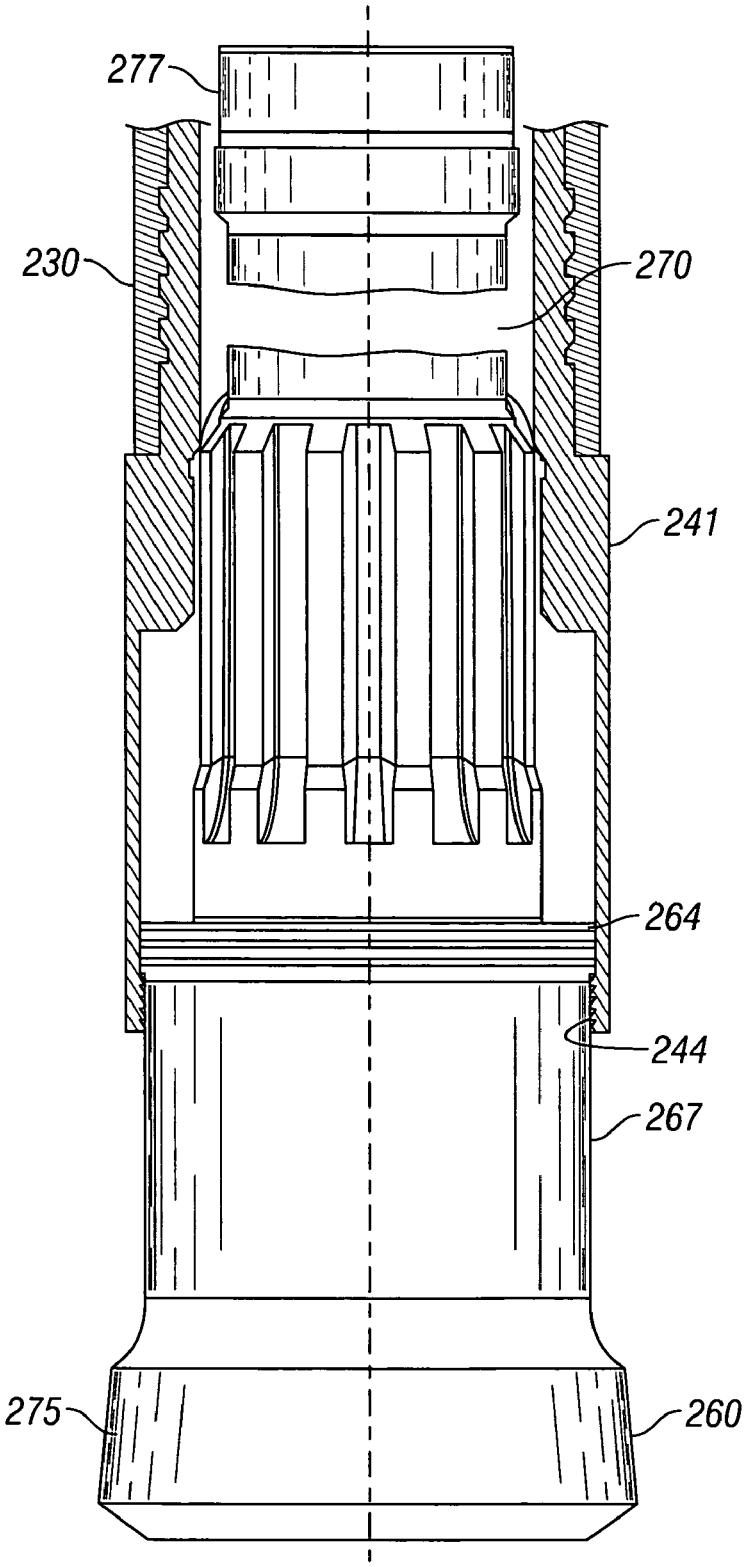
FIG. 5 is a partial cross-section view similar to FIG. 4, but showing the components of the percussion hammer drilling assembly as they appear during operation.

Referring now to FIG. 5, the bit retention properties of drive collar 241 are displayed. In FIG. 5, bit 260 has suffered a fracture 270, so that a fractured portion 275 of bit 260 is separated from an upper portion 277 of bit 260 that is above fracture 270. However, as fractured portion 275 moves farther from upper portion 275, threaded section 244 of drive collar 241 contacts threaded section 264 of bit 260. In the this embodiment, threaded sections 244 and 264 are configured so that the rotation of drive collar 241 relative to fractured portion 275 during operation will not cause threaded section 264 to threadably engage threaded section 264. For example, when viewed from above during operation, if drive collar 241 rotates clockwise, then threaded sections 244 and 264 are configured so that they only threadably engage when bit 260 is rotated counter-clockwise relative to fractured portion 275. This prevents threaded section 264 from threadably engaging and traveling past threaded section 244. Therefore, threaded section 244 acts as a retention mechanism, allowing drive collar 241 to capture fractured portion 275 and prevent it from separating from drilling assembly 300 (shown in FIG. 2). As a result, fractured portion 275 can be withdrawn from the borehole by merely removing drill string 210 and drilling assembly 300 and a separate "retrieval" procedure for the broken component is not required. This captive arrangement can save considerable time and expense in comparison to removing a fractured portion 275 of drill bit 260 from a borehole.

Comparing the embodiment shown in FIGS. 2-5 with the conventional arrangement shown in FIGS. 1 and 1A, drive collar 241 eliminates retainer shoulder 236 and driver sub shoulder 263 common in such assemblies. For example, driver collar 241 eliminates retainer shoulder 236 and driver sub shoulder 263. This in turn eliminates stress risers created by shoulders 236 and 263 and thereby reduces the likelihood of component failures as was experienced in prior art systems utilizing drive collars and retainers. In addition, because drive collar 241 is now a unitary or one-piece component, as compared to the conventional arrangement having a separate drive collar and retainer, the cross-sectional thickness of driver collar 241 in lower portion 247 can be made greater. This is an area that is often prone to erosion due to the high velocity of cuttings and air in the bore hole. Increasing the cross-sectional thickness in lower portion 247 also reduces the stress levels and increases the ability to sustain erosion, and further reduces the likelihood of fracturing drive collar 241. A one-piece assembly also is able to retain a bit shank with a relatively large spline diameter within the envelope of a given bore hole.

Figure 6:
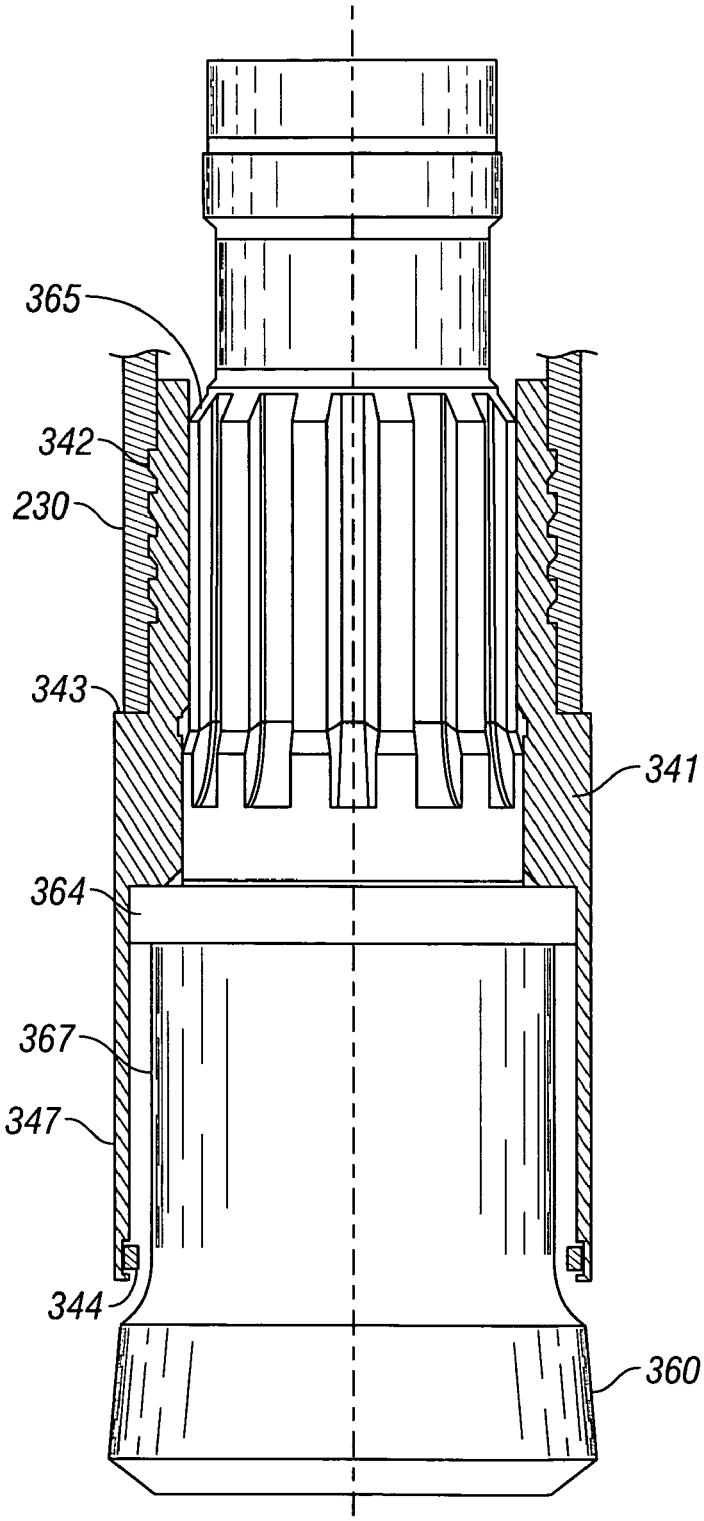
FIG. 6 is a partial cross-section view of an alternative embodiment of a percussion hammer drilling assembly made in accordance with principles of the present invention.

An alternative embodiment of the present invention is shown in FIG. 6. In this embodiment, a bit 360 is retained within drive collar 341. Bit 360 comprises a plurality of splines 365 that engage splines (not visible in FIG. 6) in drive collar 341. Bit 360 also comprises a shoulder area 364 and a reduced diameter portion 367. In this embodiment, drive collar 341 comprises a shoulder 343, an extension 347, and an upper threaded section 342 that threadably engages case 230. In the embodiment of FIG. 6, drive collar 341 comprises a retaining ring 344 on extension 347. As explained below, retaining ring 344 acts as a retention mechanism in the event that bit 360 is fractured. Retaining ring 344 can comprise various configurations, such as a snap ring inserted into a groove in extension 347, or a split ring bolted to extension 347.

Retaining ring 344 is installed onto extension 347 after bit 360 has been inserted in drive collar 341. Therefore, retaining ring 344 does not obstruct shoulder area 364 during insertion of bit 360 into drive collar 341. After bit 360 is fully inserted into drive collar 341 and splines 365 are engaged with the drive collar splines, retaining ring 344 can be installed. Retaining ring 344 projects within extension 347 so that, in the event bit 360 fractures, retaining ring 344 will prevent shoulder area 364 from passing through the end of extension 347. In this manner, the fractured portion of bit 360 will be retained, allowing removal of the fractured bit portion by withdrawing the drillstring from the borehole.

Figure 7:
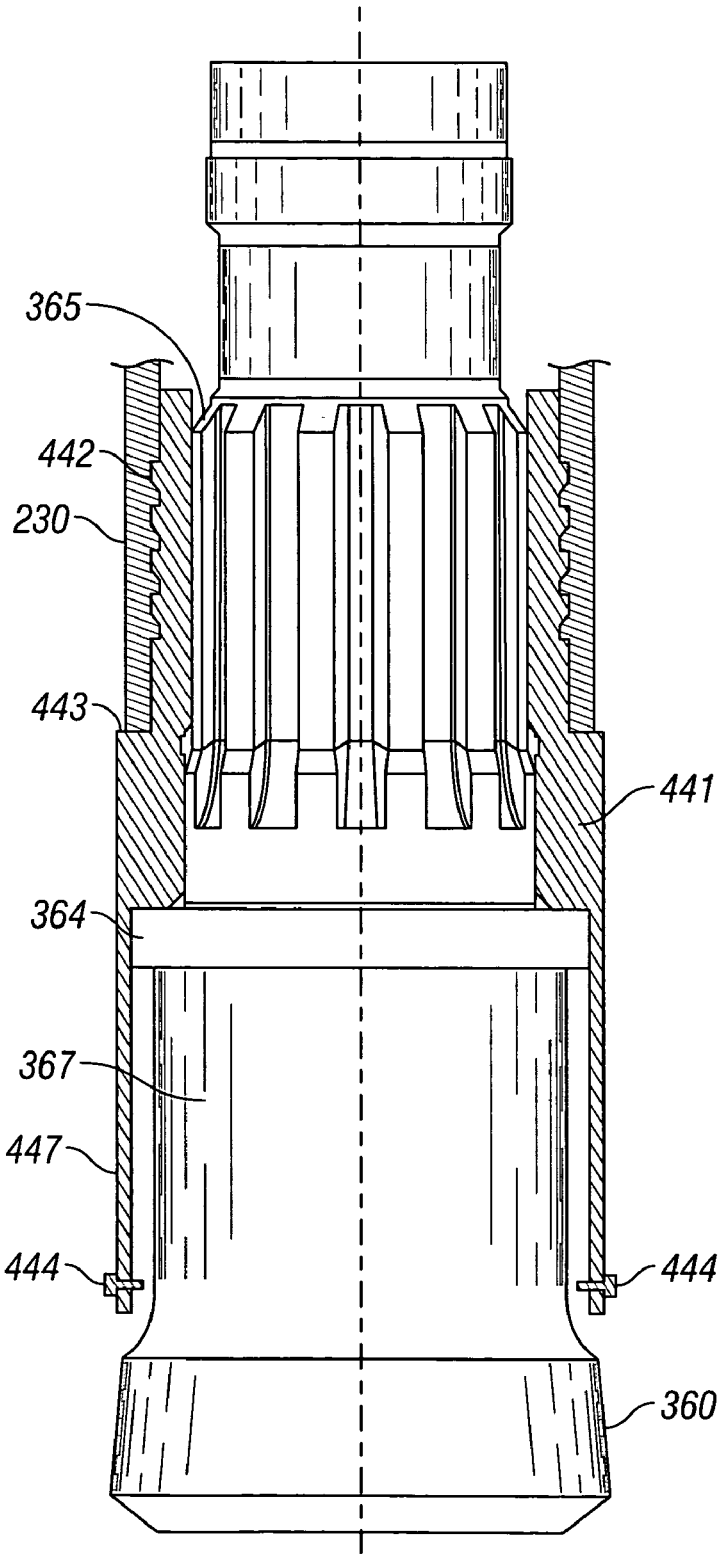
FIG. 7 is a partial cross-section view of an alternative embodiment of a percussion hammer drilling assembly made in accordance with principles of the present invention.

Another alternative embodiment of the present invention is shown in FIG. 7. In this embodiment, bit 360 is retained within drive collar 441. In this embodiment, drive collar 441 comprises a shoulder 443, an extension 447, and an upper threaded section 442 that threadably engages case 230. In the embodiment of FIG. 7, drive collar 341 comprises a plurality of pins 444 on extension 447. Similar to retaining ring 344 described in the discussion of FIG. 6, pins 444 act as a retention mechanism in the event that bit 360 is fractured.

Pins 444 can be inserted in holes in extension 447 after bit 360 has been inserted in drive collar 441. Therefore, pins 444 do not obstruct shoulder area 364 during insertion of bit 360 into drive collar 441. Pins 444 can be fastened to extension 447 in one of many different methods known in the art, such as threaded engagement or welding. Pins 444 project within extension 447 so that, in the event bit 360 fractures, pins 444 will prevent shoulder area 364 from passing through the end of extension 447. In this manner, the fractured portion of bit 360 will be retained, allowing removal of the fractured bit portion by withdrawing the drillstring from the borehole.

While various preferred embodiments of the invention have been showed and described, modifications thereof can be made by one skilled in the art without departing from the spirit and teachings of the invention. The embodiments herein are exemplary only, and are not limiting. Many variations and modifications of the invention and apparatus disclosed herein are possible and within the scope of the invention. For example, retention mechanisms other than a threaded section, a ring, or a pin may be used on the extension of the drive collar. Accordingly, the scope of protection is not limited by the description set out above, but is only limited by the claims which follow, that scope including all equivalents of the subject matter of the claims.

What is claimed is:

1. A drive collar for use in a percussion drilling apparatus of the type for boring into the earth, said drive collar comprising:
- a generally tubular, one-piece body having an inner surface, an outer surface, a first end and a second end;
- a first threaded section on the outer surface, wherein the first threaded section is proximal to the first end;
- a retention mechanism on the inner surface, wherein the retention mechanism is proximal to the second end;
- a plurality of splines on the inner surface; and
- a shoulder on the outer surface, wherein the shoulder is disposed between the first threaded section and the retention mechanism;
- wherein said retention mechanism is a second threaded section of said drive collar.

2. The drive collar of claim 1, wherein a first diameter of said inner surface proximal to said first end is smaller than a second diameter of said inner surface proximal to said second end.

3. A drive collar for use in a percussion drilling apparatus of the type for boring into the earth, said drive collar comprising:
- a generally cylindrical, one-piece body further comprising:
  - a first end;
  - a second end;
  - a first outer surface;
  - a second outer surface;
  - a first threaded section on the first outer surface;
- a plurality of splines on the first inner surface; and
  - a generally cylindrical extension disposed on the second end of the cylindrical body,
    - the generally cylindrical extension comprising a second inner surface; and
- a retention mechanism on the second inner surface of the cylindrical extension;

wherein the retention mechanism comprises a second threaded section of the generally cylindrical extension.

4. The drive collar of claim 3, further comprising a shoulder on the outer surface of the cylindrical body.

5. A drive collar for use in a percussion drilling apparatus of the type for boring into the earth, said drive collar comprising:

an upper portion comprising a threaded outer surface and an inner surface comprising a plurality of splines;

a lower portion comprising a retention mechanism; and a central portion disposed between the upper portion and the lower portion, wherein the upper portion, lower portion and central portion are generally tubular and comprised of a unitary piece;

wherein the retention mechanism is an inner threaded surface.

6. The drive collar of claim 5 wherein:

the upper portion, lower portion and central portion each have a cross-sectional thickness defined by an outer diameter and an inner diameter; and the cross-sectional thickness of the central portion is greater than the cross-sectional thickness of the upper portion and the cross-sectional thickness of the lower portion.

7. The drive collar of claim 5 wherein the plurality of splines extends from an inner surface of the upper portion to an inner surface of the central portion.

8. A drive collar and percussion bit assembly comprising:

a percussion bit comprising an elongate body having a first plurality of splines and a first threaded section;

a drive collar disposed on said drill bit, said drive collar comprising:

a generally tubular body with an inner surface and an outer surface;

a second plurality of splines on said inner surface, said second plurality of splines engaging said first plurality of splines;

a retention mechanism on said inner surface, said retention mechanism positioned so that said first threaded section of said percussion bit is between said retention mechanism and said second plurality of splines;

wherein the retention mechanism is a second threaded section.

9. A method of assembling a driver collar and percussion bit assembly, comprising the steps of:

providing a percussion bit comprising an elongate body having a first plurality of splines and a first threaded section;

providing a drive collar comprising a generally tubular body with a second plurality of splines and a second threaded section;

engaging said percussion bit and said drive collar so that said percussion bit is received within said drive collar and said first threaded section is threadably engaged with said second threaded section and said first plurality of splines is not slideably engaged with said second plurality of splines.

* * * * *